United States Patent [19]

Ellis

[11] 3,969,827

[45] July 20, 1976

[54] FOLDING WEAPON SIGHT

[75] Inventor: Paul H. Ellis, Bel Air, Md.

[73] Assignee: The United States of America as represented by the Secretary of the Army, Washington, D.C.

[22] Filed: July 11, 1975

[21] Appl. No.: 595,191

[52] U.S. Cl. ..... 33/255; 33/244

[51] Int. Cl.[2] ..... F41G 1/16; F41G 1/04

[58] Field of Search ..... 23/235, 244, 255, 256, 23/260

[56] References Cited

UNITED STATES PATENTS

| | | | |
|---|---|---|---|
| 172,465 | 1/1876 | McFarland et al. | 33/255 |
| 1,037,262 | 9/1912 | Kennedy | 33/255 |

FOREIGN PATENTS OR APPLICATIONS

| | | | |
|---|---|---|---|
| 14,093 | 1/1889 | United Kingdom | 33/255 |

*Primary Examiner*—Richard E. Aegerter
*Assistant Examiner*—Richard R. Stearns
*Attorney, Agent, or Firm*—Nathan Edelberg; Robert P. Gibson; Saul Elbaum

[57] ABSTRACT

A sighting device having a range adjustment provision which is automatically indexed to a predetermined range when the sight is moved from an operative to a stored position. When mounted to a telescoping weapon, a rear sight assembly operates a detent to allow the weapon sections to collapse and a front sight assembly is received in a recess in the rear sight assembly to lock the two sight assemblies in their stored position.

9 Claims, 5 Drawing Figures

FOLDING WEAPON SIGHT

RIGHTS OF THE GOVERNMENT

The invention described herein may be manufactured, used and licensed by or for the U.S. Government for governmental purposes without the payment to me of any royalty thereon.

BACKGROUND OF THE INVENTION

1. Field of the Invention

The present invention relates generally to folding weapon sights and more specifically to a folding sight which is automatically indexed to a predetermined range when placed in a stored position.

2. Description of the Prior Art

Previous sights were designed in such a way as to require several operations to put them in readiness and several more operations to place them in a stored position. These operations generally included unlocking from a stored position, moving to an operative position, and adjusting the range of the sight from an unknown to a desired range. After firing, the sight must be unlocked from its operative position, placed in a stored position and locked therein. The number of steps required is undesirable for high stress, battle situations. In such situations, it is imperative to reduce the number of steps required to put a sight into operative position and, in addition, it would be very helpful if the person using the weapon could be assured that the sight is indexed to a fixed range.

SUMMARY OF THE INVENTION

The sighting device of the present invention overcomes the problems of the prior art by including, on the range adjustment knob, a provision to automatically index the range to a predetermined range when the sight is moved from an operative to a stored position. The sight, being spring biased, is deployed to an operative position upon release and has a guaranteed predetermined range. When the present sighting device is mounted to a telescopic weapon, the rear sight assembly operates through an aperture in a first weapon section to release a detent, thereby allowing the weapon sections to collapse. A front sight assembly on a second weapon section is received through an opening in the front of a housing of the rear sight assembly and has a portion received in recess in the rear sight assembly to lock the two sight assemblies in their stored positions. A flat or cam surface is provided on a cylindrical range adjust knob which cooperates with a second cam surface which may be the exterior of the weapon to rotate the range knob to a predetermined range as the sight is pivoted to the stored position.

OBJECTS OF THE INVENTION

An object of the present invention is to provide a foldable sight which automatically indexes to a fixed range when stored.

Another object is to provide a sight which requires a minimum number of steps to put into operation, and to remove from operation.

A further object of the present invention is a sight which is unobtrusively stored and does not require an end cap or retainer to keep it stored.

Still another object of the invention is to provide a sight which, when moved into the stored position, operates a tube releasing detent and permitting one tube of a multiple tube weapon to be collapsed into the other tube.

A still further object of the present invention is to provide a sight which is efficiently designed from the standpoint of the human factor, with simplicity and economy.

An even further object of the present invention is to provide a sight which eliminates parts and procedural steps in its use so as to be easy and inexpensive to manufacture.

Other objects, advantages and novel features of the present invention will become apparent from the following detailed description of the invention when considered in conjunction with the accompanying drawings.

DESCRIPTION OF THE PREFERRED EMBODIMENTS

Figures 1, 3:
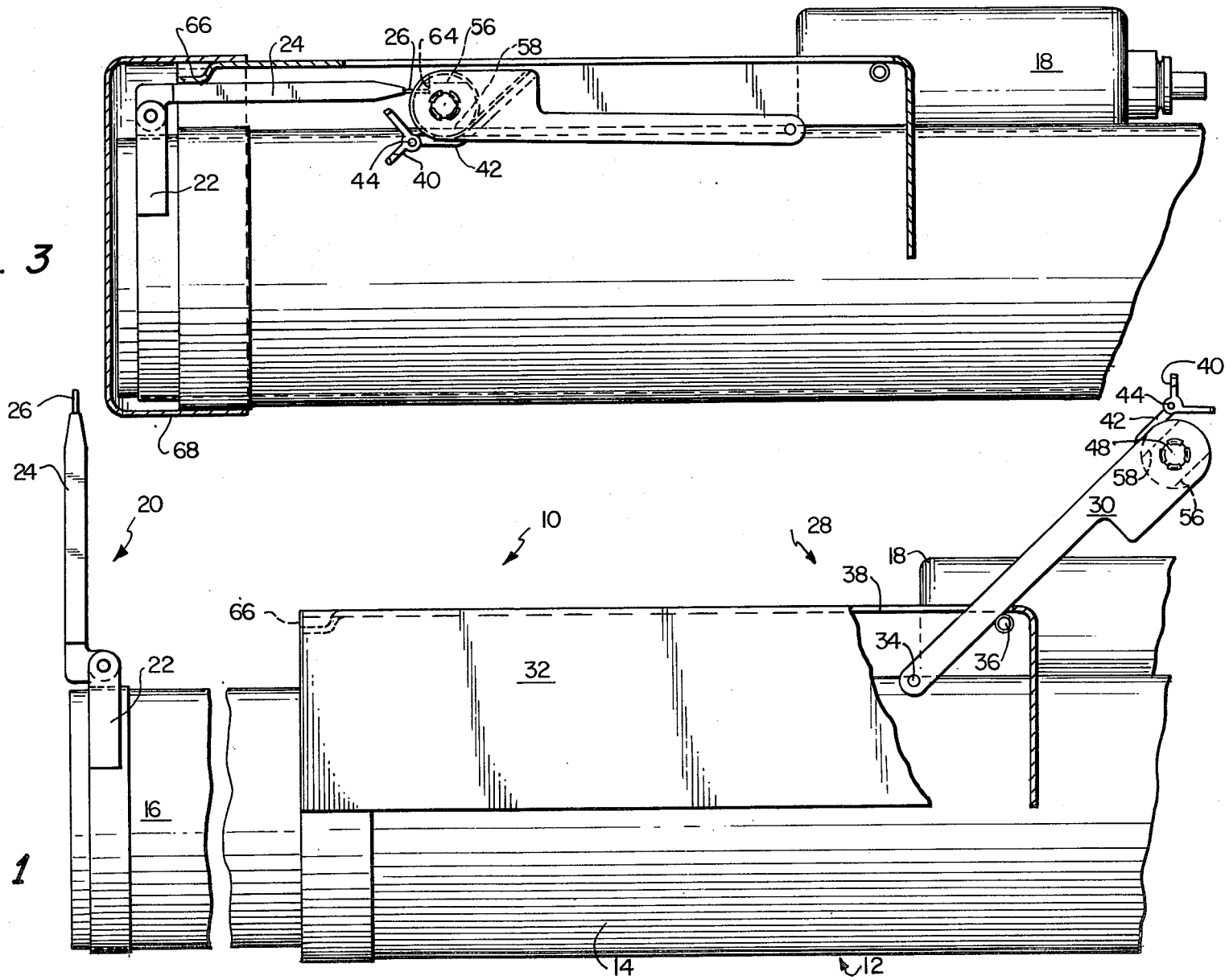
FIG. 1 is a side elevation of a telescoping weapon extended with a preferred embodiment of the sight of the subject invention in an operative position.
FIG. 3 is a side elevation of the telescoping weapon in the collapsed position with portions of a preferred embodiment of the sight of the subject invention also in the stored position, cut-away.

FIG. 1 illustrates a preferred embodiment of the folding weapon sight 10 mounted to a telescoping weapon 12 having a first section 14 receiving a second telescopic section 16 and having a firing mechanism 18. The telescoping weapon 12 is shown in its extended or operative position and may be an anti-tank weapon or a rocket launcher or some other type of weapon. Though the sight 10 of the present invention is shown as mounted to the telescoping weapon, it should be noted that the weapon itself plays no part in this invention and the sight may be mounted to any weapon, be it telescoping or otherwise.

The front sight 20 has a base 22 mounted to telescopic section 16 of weapon 12. A spring loaded arm 24 is pivotally mounted to base 22 and has a sighting post 26 extending from the top thereof. The post 26, in conjunction with the rear peep, form a conventional post/peep weapon sight familiar to all infantrymen. The width of arm 24 is predicated on a 10 mil lead for moving vehicle engagement. With this lead element, the user lines the trailing edge of arm 24 on the moving vehicle for azimuth lay and the post on the target elevation. If desired, the post 26 may be coated with a luminous material for low-light level use.

Figure 4:
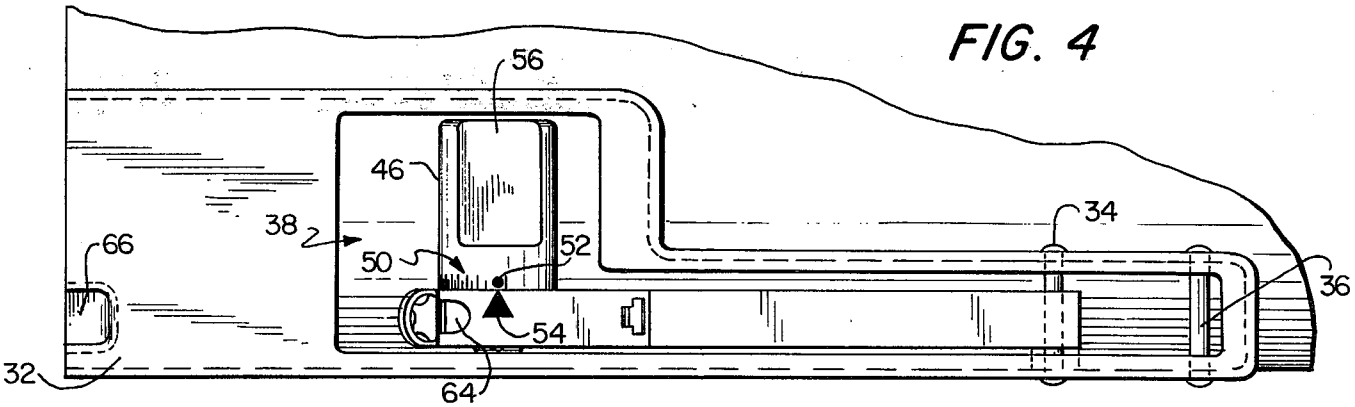
FIG. 4 is a top elevation of the rear sight of the subject invention in the stored position and mounted to a section of the weapon.

The rear sight assembly 28 includes an arm 30 pivotally mounted to a protective housing 32 by a pin 34. The arm 30 is spring loaded to assume its operative position when released and rests against a stop 36 also mounted in the protective housing 32. The rear sight assembly 28 rotates between its stored and operative position through an opening 38 in the top wall of housing 32 as shown in FIG. 4.

Mounted on the other end of arm 30 is a sight 40 having day and night apertures pivotally mounted at 44 to an elevation rack 42. The elevation rack 42 is driven by a range adjustment knob 46 also mounted to arm 30 by pin 48. The range adjustment knob 46 has range increments 50 engraved into it as well as a mark 52 corresponding to the predetermined range setting or battle sight setting. Range increments 50 and mark 52 rotate relative to a fixed reference indicia 54 provided on an arm 30.

Elevation rack 42, which supports day/night aperture sight 40, is driven up and down directly by the range adjustment knob 46. The elevation rack 42 can be made with gear teeth or a raised strip, either of which would mate with a corresponding gear or wheel on the range adjustment knob 46. If gears are used, the sight would be a gear drive, otherwise, this would be a friction drive. The specific drive or relationship between elevation rack 42 and the range adjustment knob 46 is not a part of the present invention and thus any drive system relationship may be used.

Provided on range adjustment knob 46 are two flat surfaces 56 and 58. Each of these surfaces is generally planar and lie parallel to the axis of the generally cylindrical range adjustment knob 46. Surface 58 is a camming surface which cooperates with the surface of telescopic section 14 to automatically index the sight adjustment know 46 to a predetermined range setting as indicated by mark 52. The camming operation occurs as arm 30 is moved from its operative position (as shown in FIG. 1) to its stored position (as shown in FIG. 3). It should be noted that though the present embodiment of the invention, as shown in FIG. 1, shows that the second camming surface is the exterior of telescopic section 14, a second camming surface may be provided within housing 32 other than the surface of the weapon. The essence of the automatic indexing provision is that a camming surface on the adjustment knob cooperates with a second camming surface located at the stored position within the housing 32 to cooperate to rotate the range adjustment knob 46 to a predetermined range setting. The range setting is selected and fixed by proper machining of the range knob 46 to form a planar flat 58.

Figure 5:
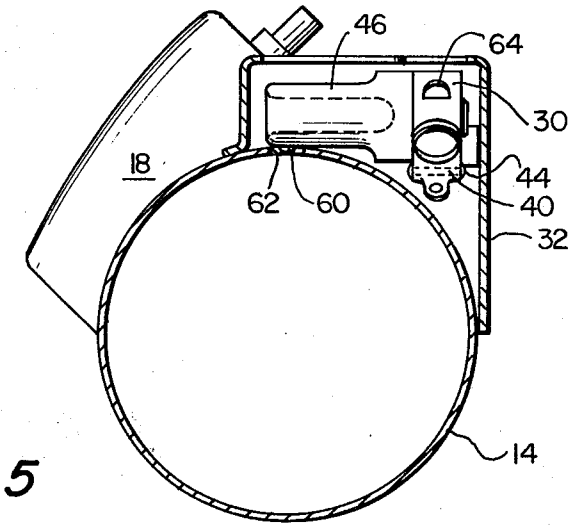
FIG. 5 is a front view of the rear sight of the subject invention in the stored position and mounted to a section of the weapon.
Figure 2:
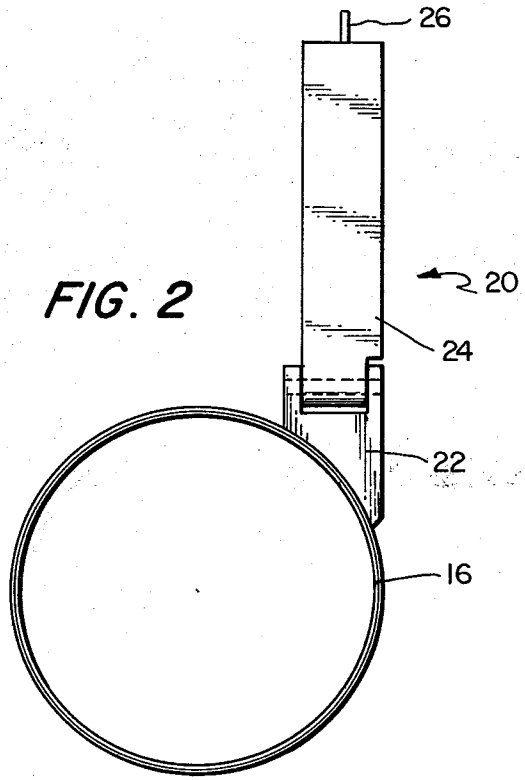
FIG. 2 is a front elevation of the front sight of the subject invention in the operative position and mounted to a section of the weapon.

A protuberance 60 is provided on range adjustment knob 46 to align with and extend through an aperture 62 in telescopic section 14 as shown in FIG. 5. The protuberance 60 extends through aperture 62 when the range adjustment knob is indexed to the preselected range in the stored position and disengages a detent (not shown). The detent, which locks telescopic sections 14 and 16 in their extended positions, when disengaged by protuberance 60 allows the telescopic section to be collapsed one into the other. A recess or slot 64 is provided in arm 30 to receive sighting post 26 of the front sight assembly 20 as shown in FIG. 3 and, as will be explained more fully hereafter, this locks the rear sight or arm 30 in the stored position. The top wall of the housing 32 is indented at 66 to receive arm 24 of the front sight 20 and maintain it in a substantially horizontal position as illustrated in FIG. 3. Also shown in FIG. 3 is an end cap 68 which may be secured to the weapon by a strip of waterproof tape, if desired.

Thus, having described in detail the elements of the preferred embodiment, their function and interrelationship will become evident from the following operational description.

The sight components are mounted on weapon 12 at the manufacturing plant. At the plant, a jig is used to assure that the rear sight assembly 28 is mounted, for example, on telescopic section 14 and the front sight assembly 20 mounted, for example, on telescopic section 16 are aligned in azimuth. Bore sighting and elevation would be accomplished by adjusting the front post 26 up and down until it is properly aligned. This adjustment can be made by providing the front post 26 of an extra long length and then precision grinding it down to a proper height. Both sight assemblies 20 and 28 are mounted at or near the forward end of their respective sections. Since bore sighting would probably be done with the weapon in its normal extended firing condition as illustrated in FIG. 1, the weapon would then have to be collapsed into its stored position as indicated in FIG. 3. To do this, the rear sight assembly 28 would be folded forward and down until the cam surface 58 of the range adjustment knob 46 encounters the surface of telescopic section 14. This would cam or index the sight to a predetermined fixed range setting. At the same time, protuberance 60 on the range adjustment knob 46 protrudes down through opening 62 in the telescopic section 14 to disengage a detent on telescopic section 16 permitting telescopic section 16 to be pushed rearward into telescopic section 14.

Before the two telescopic sections are fully nested, the front sight assembly 20 would be swung down and rearward until it is approximately parallel to the telescopic sections's axis. As tube 16 slides rearward, the front sight assembly 20 passes into the forward opening in a protecting housing 32 sliding under indented portion 66. The front sight assembly 20 is retained in this position from this point on by portion 66. During the last portion of the rearward travel, post 26 of the forward sight assembly 20 engages notch 64 in the rear sight assembly and thereby retains the rear sight assembly 28 in its stored position.

The weapon then in the stored position will be kept in such position by a retaining pin, not shown, passing through the front sight assembly in the protective housing 32. This pin arrangement is just one example of well known means for keeping sections 14 and 16 together; since they do not form a part of the invention, they are not illustrated. End cap 68 is then placed over one end of the weapon and sealed with waterproof tape, if desired.

To put the weapon into a ready-to-fire state, the user would only have to:

a. remove the protective sealing provision, i.e. end cap 68,
b. extend telescopic sections 14 and 16 fully; both sight assemblies 20 and 28 would rise up to the proper operative position and the sights would be at the preset range setting;
c. aim;
d. remove safety and fire.

If the user knows the approximate range of the target, he can dial the range with the range adjustment knob 46 and repeat steps (c) and (d). Thus, it can be seen that the preferred embodiment of the present invention is a sight that stores completely in such a way that it is always cammed or indexed to a battle sight or a fixed range setting, thereby offering high hit probability when employed quickly at unknown target ranges. This, combined with the ability to adjust the range settings with the target range when it is known and the ability to employ the sight quickly and easily makes the present invention a well engineered sight. The sight may be stored using the procedure described above for use in the manufacturing plant.

From the preceding description of the preferred embodiments, it is evident that the objects of the invention are attained and, although the invention has been described and illustrated in detail, it is clearly to be understood that the same is by way of illustration and example only and is not to be taken by way of limitation. For example, the sight assembly may be mounted to any weapon and is not limited to a telescopic weapon wherein the front sight may be movable relative to the rear sight to provide the stored capabilities. Also, it should be noted that the rear sight assembly 28 having the automatic indexing capability upon storing may be used with any locking means or any other front sight. I wish it to be understood that I do not desire to be limited to the exact details of construction shown and described for obvious modifications can be made by a person skilled in the art.

What is claimed:

1. A sighting device for a weapon comprising:

a housing to be mounted to said weapon;

an arm rotatably mounted at one end to said housing for movement between a stored position and an operative position;

first sighting means mounted on the other end of said arm, the sighting member thereof being adjustable with respect to said arm for setting said sighting member for various ranges; and means on said sighting means for automatically adjusting said sighting means to a predetermined range setting when said arm is pivoted into said stored position.

2. The sighting device of claim 1 wherein said sighting means includes a knob which rotates to adjust the range setting of said sighting means, and said automatic means includes a first cam surface on said knob and second cam surface within said housing, said cam surfaces operating to rotate said knob to adjust said sighting means to said predetermined range setting as said arm is pivoted into said stored position.

3. The sighting device of claim 2 wherein said knob is generally cylindrical, and said first cam surface is a planar surface parallel to the longitudinal axis of said knob.

4. A sighting device for use with a weapon having at least two telescoping sections capable of collapsing one into the other, the sighting device comprises:

a housing to be mounted on a first telescoping section of said weapon;

an arm rotatably mounted at one end to said housing for movement between a stored position and an operative position;

first sighting means mounted on the other end of said arm, the sighting member thereof being adjustable with respect to said arm for setting said sighting member for various ranges;

means on said first sighting means for automatically adjusting said sighting means to a predetermined range setting when said arm is pivoted into said stored position;

a base to be mounted to a second telescoping section of said weapon; and a second sighting means mounted at one end to said base for movement between a stored position and an operative position; and wherein said first sighting means includes a recess and the other end of said second sighting means lies in said recess to lock said second sighting means and said arm in their stored position when the telescopic sections are collapsed, one in the other.

5. The sighting device of claim 4 wherein said housing has an opening in a top wall to allow said first sighting means to rotate between said stored and said operative positions and said housing has an opening in a front wall to receive said second sighting means and to lock said second sighting means in its stored position.

6. The sighting device of claim 4 including two biasing means connected to said arm and said second sighting means, respectively, for urging said arm and said second sighting means to pivot to their operative positions.

7. The sighting device of claim 4 wherein said first sighting means includes a knob which rotates to adjust the range setting of said first sighting means, and said automatic means includes a first cam surface on said knob and a second cam surface within said housing, said first and second cam surfaces cooperating to rotate said knob to adjust said sighting means to said predetermined range setting as said arm is pivoted to said stored position.

8. The sighting device of claim 7 wherein said knob is generally cylindrical, said first cam surface is a planar surface and said second cam surface is the exterior of said first telescopic section, said first cam surface being substantially tangential to the second cam surface in the stored position of said arm.

9. The sighting device of claim 4 wherein said first telescoping section includes an aperture, said second telescoping section includes a detent, and said first sighting means includes a protuberance to extend through said aperture in said first telescoping section to disengage said detent when said arm is in said stored position to allow said telescoping sections to collapse one into the other.

* * * * *